US008091641B2

(12) United States Patent
Gambier et al.

(10) Patent No.: US 8,091,641 B2
(45) **Date of Patent: *Jan. 10, 2012**

(54) METHOD AND APPARATUS TO CEMENT A PERFORATED CASING

(75) Inventors: Philippe Gambier, Houston, TX (US); Simon James, Le Plessis-Robinson (FR); Christophe Rayssiguier, Melun (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 417 days.

This patent is subject to a terminal disclaimer.

(21) Appl. No.: 12/295,506

(22) PCT Filed: Feb. 16, 2007

(86) PCT No.: PCT/EP2007/001560

§ 371 (c)(1),
(2), (4) Date: Mar. 13, 2009

(87) PCT Pub. No.: WO2007/112811

PCT Pub. Date: Oct. 11, 2007

(65) Prior Publication Data

US 2009/0260817 A1 Oct. 22, 2009

(30) Foreign Application Priority Data

Mar. 31, 2006 (EP) ..... 06290518
Apr. 27, 2006 (EP) ..... 06290700

(51) Int. Cl.
*E21B 33/13* (2006.01)
*E21B 33/14* (2006.01)
*E21B 43/04* (2006.01)
*E21B 43/25* (2006.01)

(52) U.S. Cl. ..... 166/290; 166/51; 166/177.4; 166/278; 166/285; 166/305.1; 166/308.3; 166/380; 166/381

(58) Field of Classification Search ..... 166/177.4, 166/290
See application file for complete search history.

(56) References Cited

U.S. PATENT DOCUMENTS 1,758,156 A * 5/1930 Huber ..... 166/290
2,922,478 A * 1/1960 Maly ..... 166/154
3,460,625 A * 8/1969 Ellis et al. ..... 166/285
4,105,069 A 8/1978 Baker et al.
(Continued)

FOREIGN PATENT DOCUMENTS

WO 2004097167 11/2004

*Primary Examiner* — George Suchfield
(74) *Attorney, Agent, or Firm* — Myron K. Stout; Robin Nava; David Cate

(57) ABSTRACT

A method of and an apparatus for treating a near zone and/or a far zone of a well is disclosed. The method comprises the following steps. (1) A tube that is permeable to a material is placed inside a wellbore, forming an annulus inside the wellbore. (2) A setting section surrounded by a sleeve is placed inside the tube. The sleeve is expandable and impermeable to the material. (3) The sleeve is inflated so that the sleeve is in contact with the tube, ensuring that the first zone of the tube is impermeable to the material, but leaving a second zone permeable to the material. (4) A treatment fluid is pumped to the zones that passes through the second zone still permeable to the material. (5) The near zone in the annulus and/or the far zone in the surrounding formation is treated with the treatment fluid.

33 Claims, 9 Drawing Sheets

U.S. PATENT DOCUMENTS 5,297,633 A 3/1994 Snider et al.
5,337,823 A 8/1994 Nobileau et al.
5,343,956 A 9/1994 Coronado et al.
5,697,441 A 12/1997 Vercaemer
5,947,200 A 9/1999 Montgomery et al.
7,789,148 B2 * 9/2010 Rayssiguier et al. ..... 166/285
2009/0032257 A1 * 2/2009 Rayssiguier et al. ..... 166/287
2010/0025036 A1 * 2/2010 Gambier et al. ..... 166/277

* cited by examiner

METHOD AND APPARATUS TO CEMENT A PERFORATED CASING

FIELD OF THE INVENTION

The present invention broadly relates to well cementing. More particularly the invention relates to servicing apparatus for completing downhole wells from a subterranean reservoir, such as for instance an oil and gas reservoir or a water reservoir.

DESCRIPTION OF THE PRIOR ART

After a well has been drilled, the conventional practice in the oil industry consists in filing the well with a metal casing. The casing is lowered down the hole and cement is pumped inside the casing and returns through the annulus where it is allowed to set. Lining the well aims at a dual purpose: preventing the bore walls from collapsing and isolating the various geological strata and thus, avoiding exchange of fluids between them. Furthermore, it can be useful also for different reasons to fill the well with a permeable screen (meaning not impermeable as metal casing) as perforated tubular, tubular with other openings, slotted liner or expandable screen. Use of such permeable screen aims for example in allowing the oil to pass the bore walls from production zones into the hole by retaining debris. However, when a permeable screen is present downhole, there is no simple way to cement the annulus. Effectively, conventional technique where cement is pumped inside the permeable screen to be returned through the annulus will not work, because the cement will pass through the first openings of the permeable screen and no cement will be pumped at the other extremity. Further cement would fill the inside of the permeable screen and extra drilling, which is costly and time consuming, will be required after the cement is set. Even this conventional technique does not apply to other types of fluids and there is no simple way to make a treatment to a zone of the borehole behind a permeable screen.

Hence, it remains the need for a method of cementing the annulus or a method of treatment of the earth formation, behind a perforated casing, a slotted liner or an expandable and permeable screen.

SUMMARY OF THE INVENTION

According to one aspect of the invention, the invention provides a method of treatment of a near zone and/or a far zone of a well comprising a wellbore and wherein the method comprises the steps of: (i) placing inside the wellbore a tube which is permeable to a material, so that the tube forms an annulus with the wellbore, the first zone being inside the annulus and the second zone being beyond the wellbore; (ii) placing inside the tube a setting section surrounded by a sleeve, the sleeve being expandable and impermeable to the material; (iii) inflating the sleeve so that the sleeve is in contact with the tube, ensuring for a first zone of the tube impermeability to the material, but leaving a second zone permeable to the material; (iv) pumping a treatment fluid to the zones, the treatment fluid passing through the second zone still permeable to the material; and (v) treating the near zone and/or the far zone with the treatment fluid.

According to a second aspect of the invention, the invention provides a method to consolidate a near zone and/or a far zone of a well comprising a wellbore and wherein the method comprises the steps of: (i) placing inside the wellbore a tube which is permeable to a material, so that the tube forms an annulus with the wellbore, the first zone being inside the annulus and the second zone being beyond the wellbore; (ii) placing inside the tube a setting section surrounded by a sleeve, the sleeve being expandable and impermeable to the material; (iii) inflating the sleeve so that the sleeve is in contact with the tube, ensuring for a first zone of the tube impermeability to the material, but leaving a second zone permeable to the material; (iv) pumping a treatment fluid to the zones, the treatment fluid passing through the second zone still permeable to the material; and (v) treating the near zone and/or the far zone with the treatment fluid.

According to a third aspect of the invention, the invention provides a method to isolate a near zone and/or a far zone of a well comprising a wellbore and wherein the method comprises the steps of: (i) placing inside the wellbore a tube which is permeable to a material, so that the tube forms an annulus with the wellbore, the first zone being inside the annulus and the second zone being beyond the wellbore; (ii) placing inside the tube a setting section surrounded by a sleeve, the sleeve being expandable and impermeable to the material; (iii) inflating the sleeve so that the sleeve is in contact with the tube, ensuring for a first zone of the tube impermeability to the material, but leaving a second zone permeable to the material; (iv) pumping a treatment fluid to the zones, the treatment fluid passing through the second zone still permeable to the material; and (v) treating the near zone and/or the far zone with the treatment fluid.

There are possible uses of the methods, in one case, the second zone is a void making communication with the zones: this configuration can appear when the zones is at the bottom of the well and when the tube ends leaving direct communication between the inside of the well and the earth formation; this configuration can also appear in the well when an unconsolidated zone is in direct communication with the earth formation. In a second case, the second zone is an element permeable to the material, for example the permeable element can be the tube: this configuration can appear when a part the tube is made impermeable and another part of the same tube is used to ensure flow of the treatment fluid from the inside of the well to the annulus and to the zones.

Preferably, the method according to the invention further comprises the step of deflating the sleeve so that the sleeve is no more in contact with the tube near the zones; also preferably, the invention further comprises the step of removing the setting section surrounded by the sleeve from the zones. The inside of the tube is left unchanged after the zones have been treated or consolidated or isolated.

In a first embodiment, the step of placing the setting section surrounded by a sleeve is done by placing first the sleeve inside the tube and after the setting section inside the sleeve. The sleeve can be lowered in the well first, positioned near the zones; and after the setting section can be positioned inside the sleeve so the step of inflating can begin. In a second embodiment, the step of placing the setting section surrounded by a sleeve is done by placing into the tube the setting section already surrounded by the sleeve. The sleeve can be positioned on the setting section before to be positioned near the zones. Preferably, in a configuration where the well has a longitudinal axis (A), the step of placing the setting section surrounded by a sleeve further comprises the step of deploying the sleeve longitudinally to the axis (A). The sleeve is arranged like a fan on the setting section and can be deployed on its length to cover the part of the tube or all the tube to be impermeabilized.

In one example of realization, the setting section has an upper part and a lower part, the setting section being connected to a delivery section going on surface at the upper part, and being in communication with the inside of the well at the lower part through a delivery opening, and the step of pumping a treatment fluid to the zones is done by: (i) delivering the treatment fluid inside of the well through the delivery section, through the setting section and through the delivery opening; (ii) filling the inside of the well located downhole from the lower part with the treatment fluid, until the treatment fluid passes into the annulus via the second zone still permeable to the material; and (iii) rising said treatment fluid into the zones.

In a second example of realization, the setting section has an upper part and a lower part, the setting section being connected to a delivery section going on surface at the upper part, and being in communication with the inside of the well at the lower part through a delivery opening, and wherein the step of pumping a treatment fluid to the zones is done by: (i) delivering a first fluid inside of the well through the delivery section, through the setting section and through the delivery opening; (ii) filling the inside of the well located downhole from the lower part with the first fluid, until the first fluid realized a plug inside of the well; (iii) delivering the treatment fluid inside of the well through the delivery section, through the setting section and through the delivery opening; (iv) filling the inside of the well located downhole from the lower part and uphole from the plug, with the treatment fluid, until the treatment fluid passes into the annulus via the second zone still permeable to the material; and (v) rising the treatment fluid into the zones. The first fluid can be a viscous bentonite fluid, a delayed-gel fluid, or a reactive fluids system.

In a third example of realization, the setting section has an upper part and a lower part, the setting section being connected to a delivery section going on surface at the upper part, and being in communication with the inside of the well at the lower part through a delivery opening, and wherein the step of pumping a treatment fluid to the zones is done by: (i) deploying a plug inside of the well; (ii) plugging the inside of the well located downhole from the lower part with the plug; (iii) delivering the treatment fluid inside of the well through the delivery section, through the setting section and through the delivery opening; (iv) filling the inside of the well located downhole from the lower part and uphole from the plug, with the treatment fluid, until the treatment fluid passes into the annulus via the second zone still permeable to the material; and rising the treatment fluid into the zones. The plug is a device with an expandable sleeve which acts as a plug when the expandable sleeve is inflated. The plug can be deployed inside the well with the apparatus of the invention or with another apparatus.

In various possible examples of realization, the methods of the invention work when the tube is taken in the list constituted by: perforated casing, perforated tubing, perforated pipe, perforated conduit, slotted liner, screen, expandable casing, expandable screen, tube comprising opening, tube comprising permeable component, and permeable component; when the material is taken in the list constituted by: oil, water, cement, sand, gravel, gas; when the setting section is taken in the list constituted by: coiled tubing, drill pipe; when the delivery section is taken in the list constituted by: coiled tubing, drill pipe; when the sleeve is made of rubber; when the treatment fluid is a settable fluid or a non settable fluid; when the settable fluid is taken in the list constituted by: conventional cement, remedial cement, permeable cement, phosphate cement, special cement, inorganic and organic sealants, remedial resin, permeable resin, geopolymer materials; when the non settable fluid is taken in the list constituted by: acid, washer.

In the case where the treatment fluid is a settable fluid, the method further comprises the steps of: (v) allowing the treatment fluid to set; (vi) deflating the sleeve so that the sleeve is no more in contact with the tube near the zones; and (vii) removing the setting section with the sleeve from the zones by putting it out. In a preferred embodiment, the method further comprises the step of: (viii) drilling the well with a drilling tool.

According to a fourth aspect of the invention, the invention provides an apparatus for treatment or to consolidate or to isolate a near zone and/or a far zone of a well, comprising a wellbore, and the apparatus comprising: (i) a setting section surrounded by a sleeve, the sleeve being expandable and impermeable to a material; (ii) a tube which is permeable to the material, wherein the tube surrounds the sleeve; (iii) an inflating means for inflating the sleeve, the inflating means ensuring that the sleeve is in contact with a first zone of the tube so that the first zone of the tube becomes impermeable to the material; and (iv) a delivery opening for delivering a treatment fluid to the zones, the delivery opening ensuring that the treatment fluid passes, via a second zone still permeable to the material, into an annulus formed between the tube and the wellbore.

There are possible configurations of the delivery opening, in a first configuration they ensure that the treatment fluid passes into the annulus via a void making communication with the zones to treat; in a second configuration, they ensure that the treatment fluid passes into the annulus via an element permeable to the material, preferably the permeable element is a part of the tube.

Preferably also, the apparatus comprises: a deflating means for deflating the sleeve, the deflating means ensuring that the sleeve is no more in contact with the tube.

Preferably, the sleeve is attached to the tube with connecting means at the upper part and/or with connecting means at the lower part. In one embodiment, the connecting means are connected permanently to the tube; in a second embodiment the connecting means are removable connecting means; in a third embodiment the connecting means are floating means.

Preferably, the sleeve is attached to the setting section with connecting means at the upper part and/or with connecting means at the lower part. In one embodiment, the connecting means are connected permanently to the setting section; in a second embodiment the connecting means are removable connecting means; in a third embodiment the connecting means are floating means.

Preferably, the tube is attached to the setting section with connecting means at the upper part and/or with connecting means at the lower part. In one embodiment, the connecting means are connected permanently to the setting section; in a second embodiment the connecting means are removable connecting means; in a third embodiment the connecting means are floating means.

In another configuration, the setting section has an upper part and a lower part and the apparatus further comprises a delivery section going on the surface connected to the upper part.

In various possible examples of realization, the apparatus of the invention works when the tube is taken in the list constituted by: perforated casing, perforated tubing, perforated pipe, perforated conduit, slotted liner, screen, expandable casing, expandable screen, tube comprising opening, tube comprising permeable component, and permeable component; when the material is taken in the list constituted by: oil, water, cement, sand, gravel, gas; when the setting section is taken in the list constituted by: coiled tubing, drill pipe; when the delivery section is taken in the list constituted by:

coiled tubing, drill pipe; when the sleeve is made of rubber; when the treatment fluid is a settable fluid or a non settable fluid; when the settable fluid is taken in the list constituted by: conventional cement, remedial cement, permeable cement, phosphate cement, special cement, inorganic and organic sealants, remedial resin, permeable resin, geopolymer materials; when the non settable fluid is taken in the list constituted by: acid, washer.

In examples of realization, the inflating means is a device delivering a gas and/or a liquid inside the sleeve; is a check valve delivering mud into the inside of the sleeve; is a pump delivering mud into the inside of the sleeve.

In other examples of realization, the apparatus further comprises a deflating means for deflating the sleeve, the deflating means ensuring that the sleeve is no more in contact with the tube and wherein the deflating means is a device releasing the gas and/or the liquid from the sleeve.

According to a fifth aspect of the invention, the invention provides an apparatus for treatment or to consolidate or to isolate a near zone and/or a far zone of a well, comprising a wellbore, and the apparatus comprising: (i) a stinger assembly comprising a stinger mandrel at the lower part, and a seal and a first thread at the upper part; (ii) a bladder assembly comprising a bladder which is expandable and impermeable to a material, a check valve for inflating the bladder, a lower attachment assembly and an upper attachment assembly, wherein the stinger mandrel fits in the lower attachment assembly and the seal fits in the upper attachment assembly; (iii) a liner string comprising a tube which is permeable to the material and comprising a delivery opening for delivering a treatment fluid, a guide, a seat and a second thread, wherein the lower attachment assembly fits in the guide, the upper attachment assembly fits in the seat and the first thread fits in the second thread; and (iv) a running tool going to surface and connected to the stinger assembly at the upper part; wherein, the check valve ensures inflation so that the sleeve is in contact with a first zone of the tube so that the first zone of the tube becomes impermeable to the material; and the delivery opening ensures delivery so that the treatment fluid passes, via a second zone still permeable to the material, into an annulus formed between the stinger assembly and the wellbore and into the zones.

In various possible examples of realization, the apparatus of the invention works when the tube is taken in the list constituted by: perforated casing, perforated tubing, perforated pipe, perforated conduit, slotted liner, screen, expandable casing, expandable screen, tube comprising opening, tube comprising permeable component, and permeable component; when the material is taken in the list constituted by: oil, water, cement, sand, gravel, gas; when the running tool is made of part of elements taken in the list constituted by: coiled tubing, drill pipe; when the bladder is made of rubber; when the treatment fluid is a settable fluid or a non settable fluid; when the settable fluid is taken in the list constituted by: conventional cement, remedial cement, permeable cement, phosphate cement, special cement, inorganic and organic sealants, remedial resin, permeable resin, geopolymer materials; when the non settable fluid is taken in the list constituted by: acid, washer.

Preferably, the check valve delivers a gas and/or a liquid inside the bladder; the liquid can be mud.

BRIEF DESCRIPTION OF THE DRAWINGS

Further embodiments of the present invention can be understood with the appended drawings:

FIG. 3 shows a view in details of a liner string used in the method of the invention.

FIG. 4 shows a view in details of a bladder assembly used in the method of the invention.

FIG. 5 shows a view in details of a stinger assembly used in the method of the invention.

DETAILED DESCRIPTION

Figure 1A:
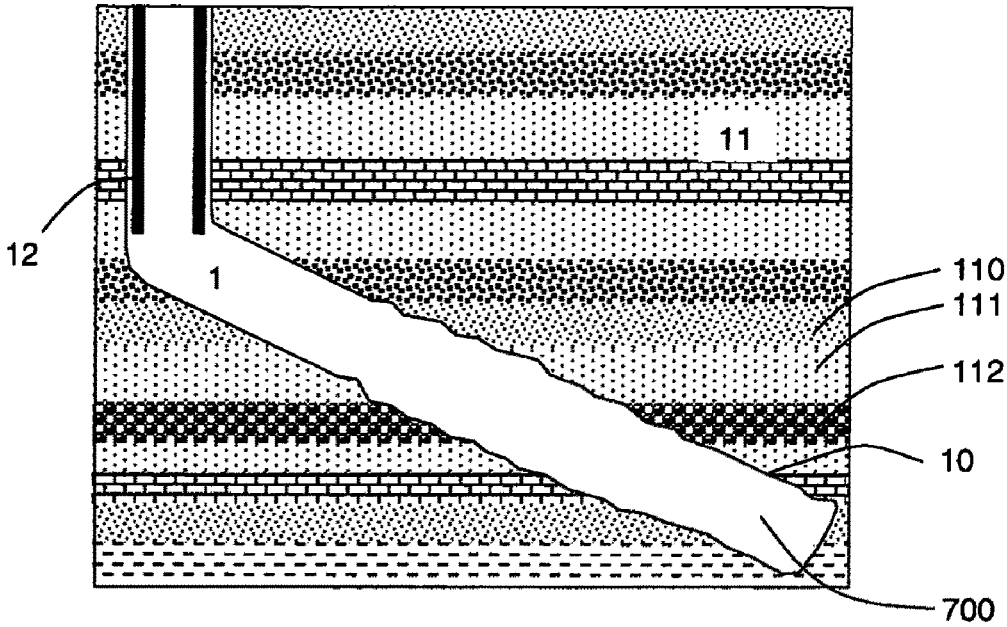
FIG. 1A to FIG. 1G show a schematic diagram illustrating the method according to the invention.

The present invention involves the use of an expanding sleeve that selectively isolates a portion of a permeable tube such as a perforated casing, or a slotted liner or an expandable and permeable screen, this isolation allowing the further treatment of the annulus zone between the permeable tube and the borehole, such treatment can be a cementing operation. The typical applications for which the apparatus and method of the invention can be used include sand control and support of wellbore producing formations, in water, oil and/or gas wells. The apparatus and method of the invention can be used also in all type of geometry of wellbores, as highly deviated and horizontal wellbores.

FIGS. 1A to 1G are an illustration of the various steps of the method according to the invention. The method is intended for application in a well 1. The well is made of a wellbore 10 which is in communication with an earth formation 11, the earth formation comprising various strata of materials (110, 111 and 112). A casing 12 surrounded by an annular space filled with cement isolates the various producing zones from each other or from the well itself in order to stabilize the well or prevent fluid communication between the zones or shut off unwanted fluid production such as water. The inside of the well 1 is filled with a fluid 700 which is for example mud or drilling mud.

Figure 1B:
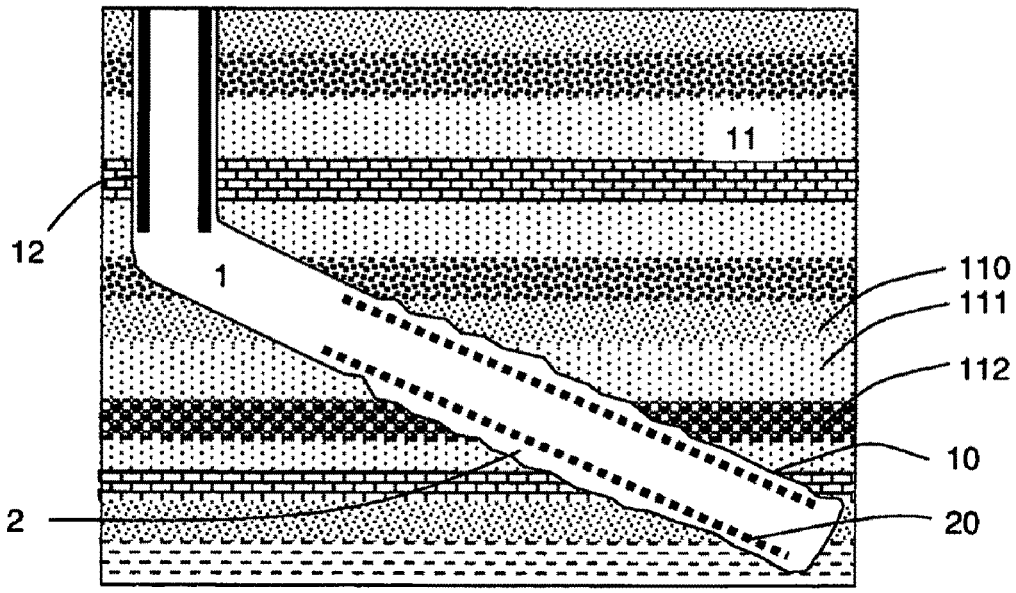

FIG. 1B shows the deployment of a permeable tube or screen 20 such as a perforated tubular, a tubular with other openings, a slotted liner or a screen (standalone, expandable or prepacked). The permeable tube 20 is placed inside the well 1 and forms an annulus 2 between said tube 20 and the wellbore 10. The tube 20 is at least permeable to one material—permeable, meaning allowing the flowing of said one material through said tube—. Further, the tube 20 can be impermeable or can play the rule of a barrier to another material—impermeable, meaning not allowing the flowing of said another material through said tube—. The tube 20 can also be for example a type of sieve, where the tube allows the crossing of a material or morphology of material, as water or fine sand; and blocks the crossing of another material or another morphology of material, as stone or medium sand. The method according to the invention can be deployed when the tube 20 is at the bottom of the well or anywhere in the well, or when the tube 20 is further associated downhole and/or uphole with a casing. When referring to uphole, it is meant going towards the surface and downhole, it is meant going away from the surface.

The method of the invention is a method of treatment of a zone of the well which is located below the placed tube 20. Zone is defined as a part of the well or a region of the well which is delimited, but which can be quite small—from one cubic meter to ten cubic meters—and which can also be quite large—from hundred cubic meters to ten thousand cubic meters—.

Figure 1C:
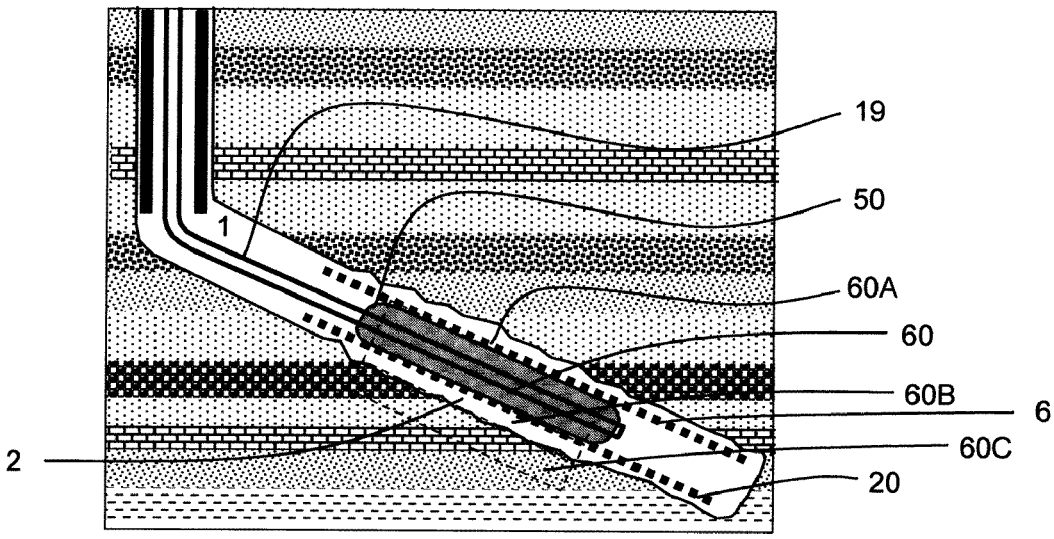

FIG. 1C shows the deployment of an apparatus 40 according to the invention. The apparatus 40 is lowered in the well from the surface, it comprises a setting pipe 19. The setting pipe at its lower section is surrounded by an expandable sleeve or bladder 50. The sleeve 50 is at least impermeable to the said one material that the tube 20 is permeable—impermeable, meaning not allowing the flowing of said one material through said sleeve—. Further, the sleeve 50 can be permeable to another material—permeable, meaning allowing the flowing of said another material through said sleeve—. Preferably, the sleeve 50 is cylindrical and connected to the setting pipe 19 by one connecting means at the upper level and with a second connecting means at the lower level. The connecting means ensure tightness of the system {sleeve and setting section}. The connecting means are distant from some meters to several meters; preferably the connecting means are distant from a length D varying from 1 meter to 200 meters; more preferably between 1 meter and 50 meters. As it can be understood when the length D is of some meters (for example up to 10 meters), the lower section with sleeve can be mounted on the surface, and the apparatus 40 can be lowered and run in the well and finally, deployed when required near the zone to treat. However, when the lower section of the apparatus 40 has a length D of several meters (below 10 meters or 100 meters for example), it is becoming hard to mount the setting pipe directly with the sleeve fully deployed on the surface. In a first aspect of the invention, the lower section of the apparatus 40 has a setting pipe already surrounded and mounted with a sleeve, the assembly being done at the surface or directly at the factory, the apparatus being lowered as such in the well. In a second aspect of the invention, the lower section of the apparatus 40 has a setting pipe surrounded with a sleeve, but not fixedly pre-mounted. The sleeve is deployed inside the well near the tube first, and the setting pipe is positioned inside said sleeve after. Further, the sleeve can preferably be arranged as a fan and can be deployed gradually on the setting section at the surface when lowered into the well or in the well when deploying near the tube. This second aspect of the invention will be explained below in more details.

The sleeve 50 is positioned inside the tube 20 in a zone 60. The zone 60 delimits the location where the sleeve 50 has to be positioned to ensure an efficient method of treatment. The zone 60 is defined by a cylinder inside the well, wherein the external surface of the cylinder is delimited by the tube 20. The zone of treatment can be delimited by a near zone 60B and a far zone 60C. The near zone 60B is defined by an annulus surrounding the zone 60, delimited by the tube 20 and the wellbore 10. The far zone 60C is defined by an annulus also surrounding the zone 60B, delimited at one side by the wellbore 10 and stretching into the earth formation from a fixed length L, varying from few centimeters to few meters, preferably the length L is between 2 centimeters to 15 meters and more preferably between 10 centimeters to 5 meters.

Figure 1D:
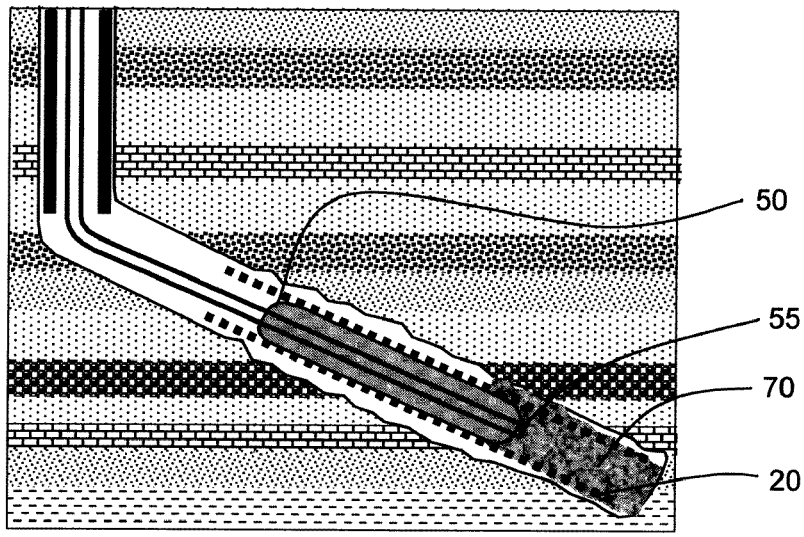

FIG. 1D shows the further step of deployment of the apparatus 40 according to the invention. The sleeve 50 is inflated thanks to an inflating means located on one connecting means. The inflating means can also advantageously be located on another portion of the tool communicating with the inside of the system {sleeve and setting pipe}. The sleeve 50 is inflated with a component 13, which can be mud, water, Nitrogen or any type of gas or liquid. In one embodiment, the inflating means is a check valve or any type of valve allowing circulating mud from the inside of the well into the inside of the sleeve 50 but not the reverse. In a second embodiment, the inflating means is a pump in communication with the inside of the well delivering mud as component 13. In a third embodiment, the inflating means is a reservoir delivering gas as component 13, said gas can be Nitrogen, carbon dioxide or air. The inflating means can be self activated or activated remotely from surface or activated by a timer or by another device located in the well. When inflated, a part of the sleeve is in contact with a zone of the tube 20, said contact zone or interface is called zone 60A. The zone 60A should be comprised in the surface defined by the intersection of zone 60 and zone 60B. The sleeve 50 is inflated enough to ensure a tight contact. Said tight contact ensures that the zone 60A made of the interface sleeve/tube becomes impermeable to the said one material that the tube 20 is permeable. A zone 6 is left permeable to the said one material, so the material can flow from the inside of the well to the annulus 2 and to the zone 60B through the zone 6. The zone 60A can cover the entire tube 20 and the zone 6 can be a zone, located downhole compared to apparatus 40 or below the setting pipe 19 and the sleeve 50, void of casing or tube directly in communication with the annulus and with the zone 60B. Also the zone 60A can cover a part of the tube 20 and the zone 6 can be another part of the tube 20 still permeable, said another part located downhole compared to apparatus 40 or below the setting pipe 19 and the sleeve 50. The sleeve 50 follows the shape of the setting section when deflated and has a shape practically cylindrical when inflated.

Figure 1E:
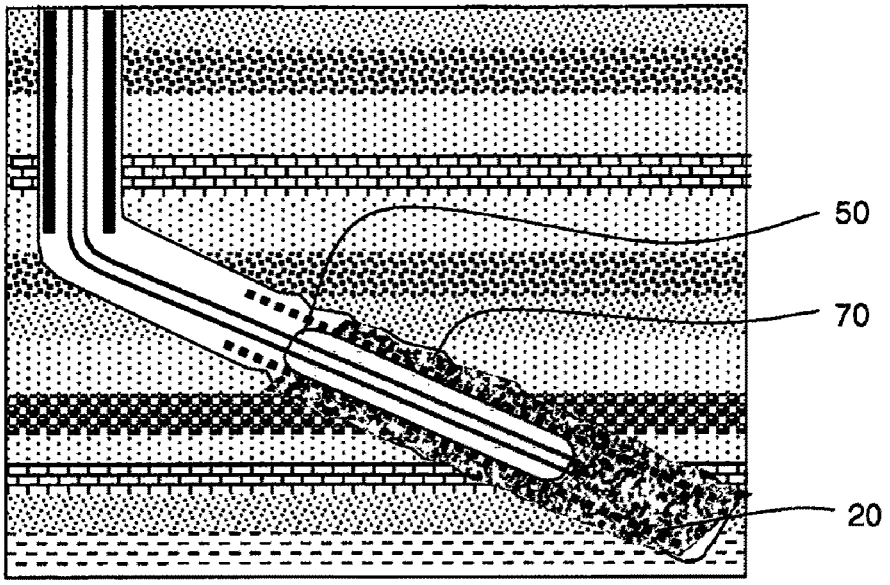

FIG. 1E shows the pumping of a treatment fluid 70 into the well. The treatment fluid is a component that flows through the tube 20—the tube 20 is permeable to this treatment fluid 70—. The treatment fluid flows into the well through delivering means or delivery opening positioned at the lower end of the setting pipe 19 below the sleeve 50. Once arrived below the setting pipe 19, the treatment fluid 70 tends to returns to the surface. Ideally the treatment fluid 70 should have the same density as the fluid 700 already in the well. As the sleeve 50 plugs the inside of the tube 20, the treatment fluid 70 is forced to circulate through the tube 20 or at least through the part 6 of the tube 20, and the treatment fluid 70 will flow all along the annulus 2 between the zone 60A and the wellbore. If the treatment fluid has not the same density as the fluid 700 already in the well, there is a risk that by gravity the treatment fluid 70 will first fill part of the well below the setting pipe 19 and the sleeve 50 (said zone below zone 60 is called zone 70A—FIG. 1G—) despite the fact that said zone 70A is closed volume already filled with the fluid 700. For example, to limit this risk, as it will be explained below in more details, few barrels of a viscous fluid can first be pumped into said zone 70A or at least into a part of said zone 70A.

Aim of the impermeabilisation of the zone 60A allows the treatment fluid 70 to rise into the zone 60B instead of rising into the inside of the well via zone 60. Once the entire zone 60B to be treated is filled with the treatment fluid, the pumping of the treatment fluid is stopped. Advantageously, depending on the composition of the treatment fluid 70 and on the composition of the earth formation beyond the wellbore (in the zone 60C), the treatment fluid can, after having filled the zone 60B, flow into the zone 60C. The pumping of the treatment fluid can be re-launched if needed to compensate for the fluid treatment flowing into the zone 60C and re-stopped when required. This step can be further re-executed a number of times, as needed. All along this time, the sleeve 50 is left inflated, ensuring impermeability of zone 60A, the time needed that the treatment fluid 70 makes its action in zone 60B and/or in zone 60C. As a first example of realization, the treatment fluid can be an acid for acid fracturing of the zone 60C or a chemical activator for activating zone 60C. As a second example of realization, the treatment fluid can be a settable fluid to set in zone 60B and/or in zone 60C, the settable fluid can be a permeable cement, a remedial cement or any type of cement or other sealant e.g. epoxy or furan resin. Further type of treatments can also be combined.

Figure 1F:
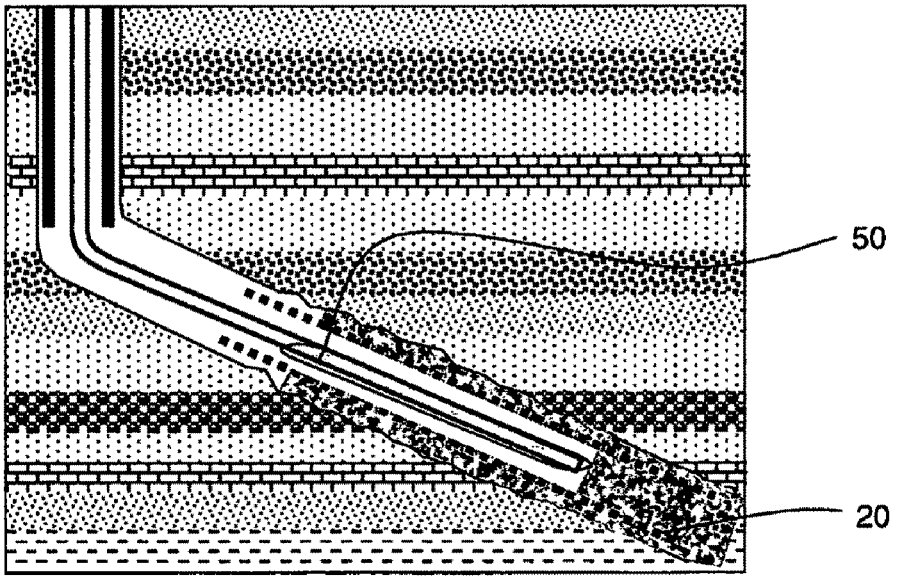
Figure 1G:
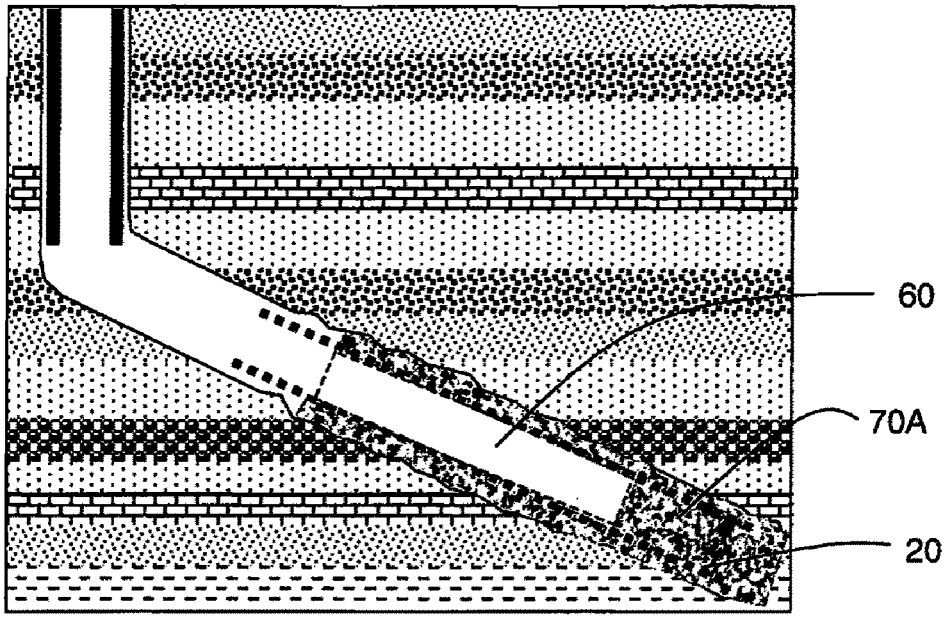

After the zone 60B and/or the zone 60C is treated, the sleeve 50 is deflated (FIG. 1F). The sleeve 50 is deflated thanks to a deflating means located on one connecting means. The deflating means can also advantageously be located on another portion of the tool communicating with the inside of the system {sleeve and setting pipe}. Preferably, the deflating means and the inflating means are the same means allowing choice between inflation or deflation of the sleeve. For the first example of realization, when the treatment fluid is a non-settable fluid, but an acid or activator, the deflated sleeve allows the treatment fluid to flow back into the well. Advantage of the use of the sleeve, is that the treatment of the zone 60B and/or the zone 60C can be done with a lesser quantity of treatment fluid than will be needed without sleeve—without sleeve, the entire zone 60 would have needed to be filled with the treatment fluid—. For the second example of realization, when the treatment fluid is a settable fluid, the deflated sleeve leaves the zone 60B and/or zone 60C with the set fluid. Advantage of the use of the sleeve, is that the inside of the tube 20 is left void of any type of pollution, as set fluid—without sleeve, the entire zone 60 would have been filled with the set fluid, requiring a further step of drilling the entire zone 60—. FIG. 1G shows the same well as in FIG. 1A after placement of the permeable tube and treatment with the method and apparatus according to the invention with a settable fluid. The apparatus 40 with the sleeve 50 has been removed from the well. The zone 60B and/or the zone 60C have been treated and the entire zone 60 remains unaffected by the treatment.

In a first embodiment, the method and the apparatus according to the invention are deployed at the bottomhole of the well, all the volume of the zone 70A left downhole of the apparatus 40 can be filled with the treatment fluid. After the treatment is finished, if a settable fluid is used, the set fluid remained in zone 70A can be drilled with a drilling tool lowered into the well from the surface.

In a second embodiment, the method and the apparatus according to the invention are deployed anywhere in the well, the volume of the zone 70A left downhole of the apparatus 40 is unknown and considered big. If the treatment fluid 70 has the same density as the fluid 700 already in the well, there is no risk that the treatment fluid fills first the zone 70A. However, if the treatment fluid 70 has not the same density as the fluid 700 already in the well two solutions can be used. One solution can be to pump few barrels of a viscous fluid into a part of said zone 70A, for example viscous fluid can be viscous bentonite pill, a delayed-gel, a reactive fluids system (RFS). If this is not sufficient, a second solution can be to mechanically isolate a part of said zone 70A with a second apparatus. Said second apparatus will be deployed first and will act as a plug so to limit the zone 70A to a smallest volume. An example of such a second apparatus can be found in U.S. Pat. No. 3,460,625; U.S. Pat. No. 2,922,478 and preferably in the co-pending European patent application from the Applicants under application number 05291785.3. Preferably, said second apparatus is deployed with the apparatus 40 and is positioned downhole compared to the apparatus 40; the second apparatus acts as a plug and the apparatus 40 can be used as described from FIG. 1D to 1G. The plug can be reusable or releasable. As a first example of embodiment, when the treatment fluid is a non-settable fluid, the second apparatus can be connected to the apparatus 40 and can have a reusable plug which is deployed the time the sleeve 50 is inflated. When the sleeve 50 is deflated, the plug is removed also—the plug can also be an expandable sleeve for example—. So, the treatment fluid falls into the well when the apparatus 40 and the second apparatus are removed from the well, leaving the zone 60B and/or the zone 60C treated and the inside of the tube near zone 60 void of any pollution. As a second example of embodiment, when the treatment fluid is a settable fluid, the second apparatus can be connected to the apparatus 40 and can have a releasable plug which is deployed the time the sleeve 50 is inflated. When the sleeve 50 is deflated, the apparatus 40 and the second apparatus are removed, the plug is released. Either the volume of the set fluid in zone 70A is sufficient to push the plug downhole and the plug falls lower into the well or zone 70A with the plug can be drilled with a drilling tool lowered into the well from the surface.

In a further step, a permeable tube can be placed in another zone of the well and said another zone can be treated with the method according to the invention by deploying the apparatus, if for example there are multiple and separated zones in the well or if the zone to be treated is too long to be treated with a single treatment.

Figure 2:
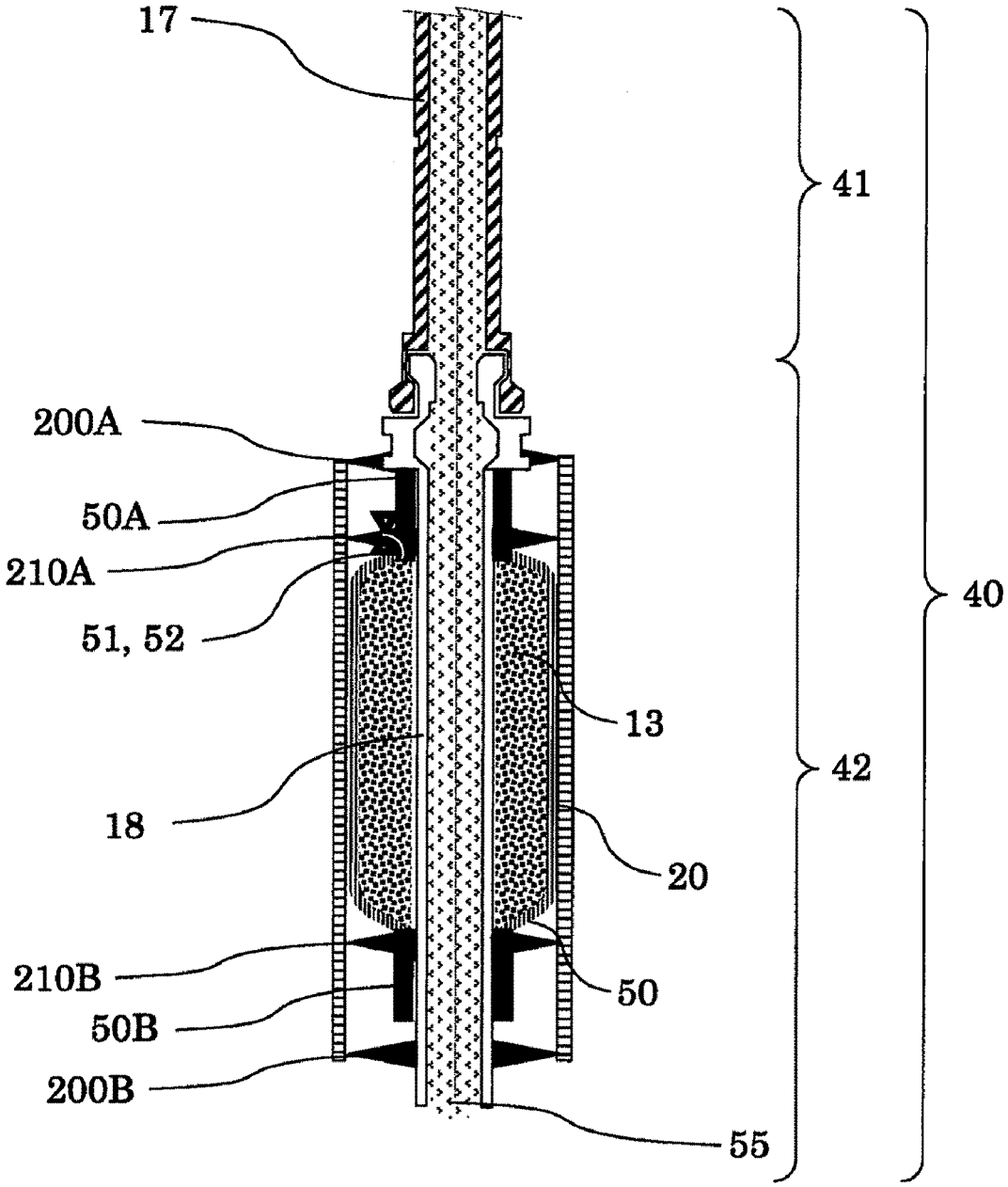
FIG. 2 shows a view in details of the apparatus according to the invention in a first embodiment.

FIG. 2 shows a view in details of the apparatus according to the invention in a first embodiment. The apparatus 40 is lowered in the well from the surface, it comprises an upper section 41 made of a delivery pipe 17 and a lower section 42 made of a setting section 18, with the bladder 50 and the permeable tube 20. The delivery pipe 17 can be a drill pipe or coiled tubing. The setting section 18 can be a drill pipe or coiled tubing, it can be also a tube made of metal or a rigid and resistant material as composite. The setting section 18 is surrounded by an expandable sleeve or bladder 50. The expandable sleeve 50 can be formed from an elastic but resistant material, for example rubber. The expandable sleeve is connected to the setting section 18 by one connecting means 50A at the upper level and with a second connecting means 50B at the lower level. The connecting means 50A and 50B are systems of fixation of the expandable sleeve 50 to the setting section 18 as screwing, hanging, sticking, crimping, hooping. The sleeve 50 is inflated thanks to a check valve 51-52 located on the connecting means 50A. The sleeve 50 is inflated with mud 13 present inside the well. The sleeve is deflated thanks also to the check valve 51-52 when it is unlocked and allows exit of mud. Alternatively, a straight pull can shear and disconnect the connecting means 50B to deflate the sleeve. The expandable sleeve 50 is surrounded by the permeable tube 20. The permeable tube can be connected to the setting section by one connecting means 200A at the upper level and with a second connecting means 200B at the lower level. And/or alternatively, the permeable tube can be connected to the bladder 50 through the connecting means 50A by one connecting means 210A at the upper level and can be connected to the bladder 50 through the connecting means 50B by a second connecting means 210B at the lower level. The apparatus 40 comprises a hole 55 at the lower level of the lower section 42 to ensure delivering of the fluid treatment inside the well.

Figure 3:
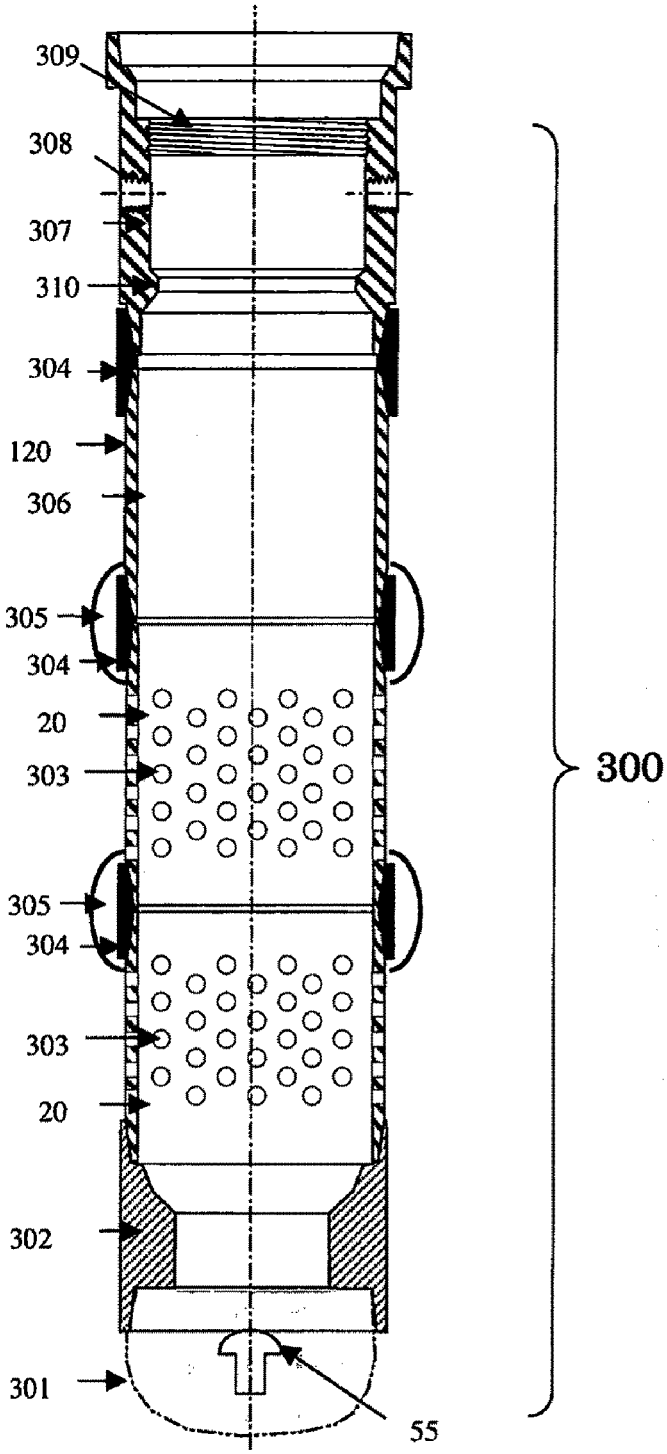
FIGS. 3 to 5 show a view in details of the apparatus according to the invention in a second embodiment.
Figure 4:
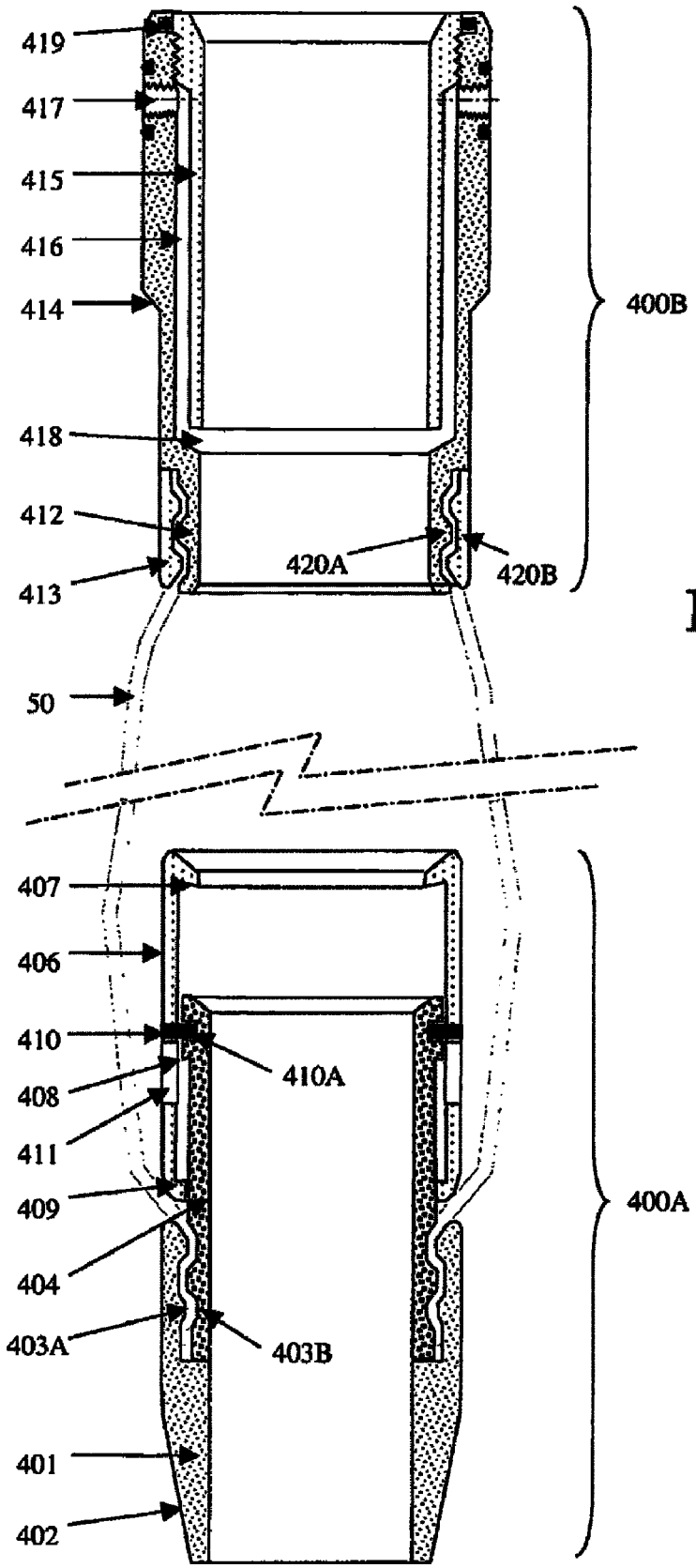
Figure 5:
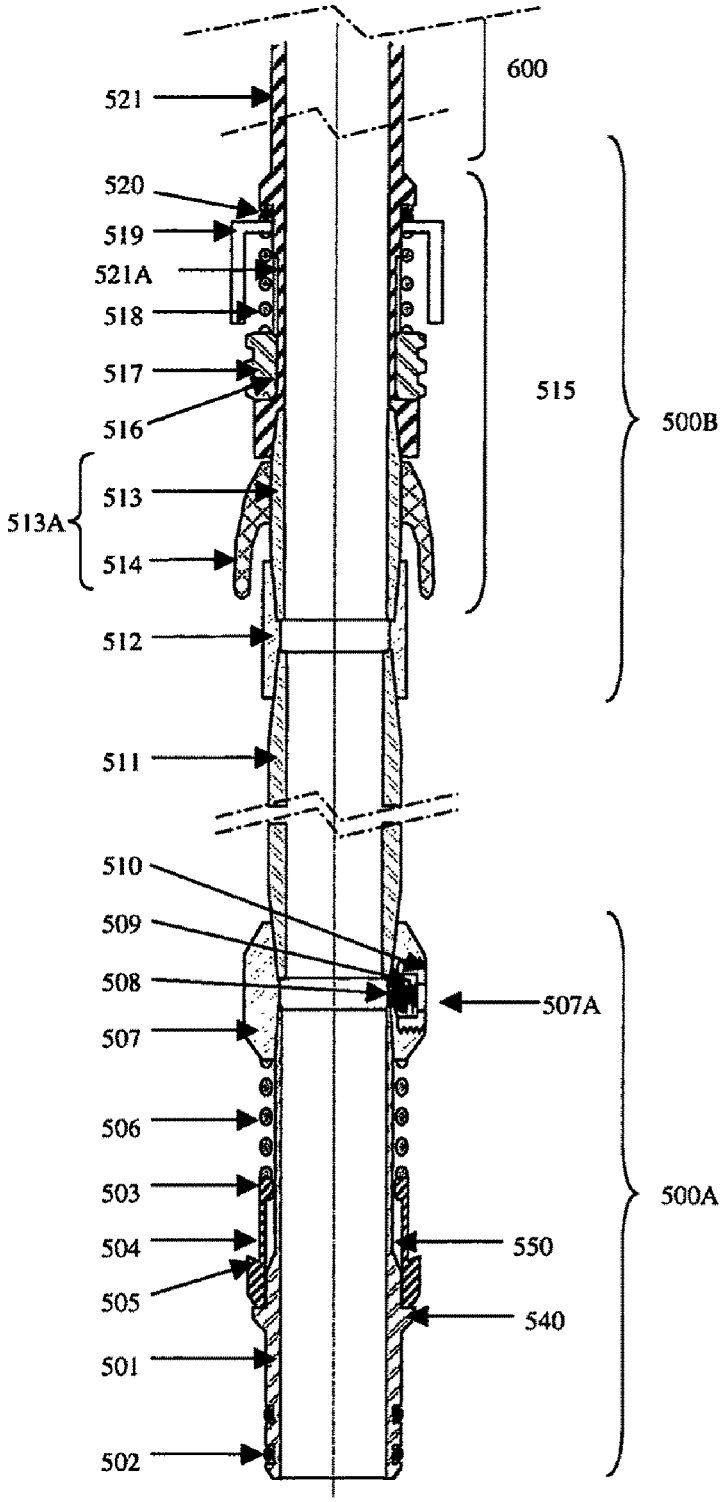

FIGS. 3 to 5 show several detailed views of the apparatus according to the invention in a second embodiment. The apparatus 40 is made of four principal elements: a liner string 300, a bladder assembly 400, a stinger assembly 500, and a running tool 600. Referring to FIG. 5, the stinger assembly 500 corresponds to an improvement of the basic setting section 18. The stinger assembly is connected to the running tool 600 via a liner hanger running tool 515. The running tool 600 corresponds to the upper section 41 of the apparatus 40. Also, the running tool 600 can be embodied as a simple drill pipe or coiled tubing. The FIG. 4 shows the bladder assembly 400 and the FIG. 3 shows the liner string 300. The liner string 300 comprises the permeable tube 20. The apparatus 40 is lowered in the well from the surface the four principal elements directly mounted or the apparatus 40 is mounted inside the well by lowering successively each of the four principal elements constituting it.

FIG. 3 shows a detailed view of the liner string 300. The liner string comprises the permeable tube 20 or an assembly of permeable tubes mounted with additional elements to ensure easy use of the method of the invention. The liner string is made of a standard shoe 301 with check valve, a guide 302 for a lower attachment assembly 400A (part of the bladder assembly 400, FIG. 4) of the bladder or sleeve 50. The liner string further comprises any number of permeable tubes 20, connected together with couplings 304 or connected to a standard tube 120 also with a coupling 304. Those non-permeable tubes form an extension to the permeable tubes, to allow pumping some excess of treatment fluid without filling the space above the tool 400. This is important when the treatment fluid can set such as cement. On the FIG. 3, two permeable tubes embodied as perforated casing joints 303 are present and the standard tube 120 embodied as a standard casing 306 located upper is present. The coupling 304 can further receive a centralizer 305 so that the liner string is correctly centralized in the wellbore 10. The liner string further comprises a nipple 307 for a liner hanger running tool 515 (FIG. 5), with a seat 310 and with a left-hand thread 309. Several ports 308 communicate with the upper attachment ports for test and filling purposes.

FIG. 4 shows a detailed view of the bladder assembly 400. The bladder assembly comprises the bladder 50, the lower attachment assembly 400A with a telescopic latch tube, and an upper attachment assembly 400B with filling ports. The lower attachment assembly is composed of a sleeve 401 with a large chamfer 402 to guide it while running inside the liner string 300, a mandrel 404 with a specific profile 403 that fits the profile cut in the sleeve, which allows to secure the bladder 50, and a telescopic latch tube 406. This latch tube 406 has an internal recess 407 so that a stinger mandrel 501 (part of the stinger 500, FIG. 5) can catch the latch tube 406 and pull it upward. The latch tube 406 is maintained in the lower position by a set of shear screws 410 whose extremities engage a groove cut 410A in the mandrel 404. When the tensile load applied by the latch mandrel 501 exceeds the setting of the screws, they shear and the telescopic latch tube 406 can move upward until a shoulder 409 stops against a mandrel shoulder 408. In that position, several large ports 411 are located on the latch tube 406 to create a path for fluid circulation. The bladder 50 is respectively trapped between a male profile 403A of the sleeve 401 and a female profile 403B of the mandrel 404. As an example of implementation, the outside diameter of the sleeve has been crimped over the mandrel, compressing the bladder to maintain it in place.

The upper attachment assembly is composed of a similar fixation of the bladder between an upper mandrel 412 and an upper sleeve 413, comprising a male profile 420A and a female profile 420B. The upper mandrel 412 has an external shoulder 414 whose diameter is slightly larger that the diameter of the seat 310 (part of the liner string 300, FIG. 3) in order to prevent the upper attachment assembly to fall down into the well. A sealing tube 415 is secured and sealed on the upper mandrel 412 by standard means (thread and seal 419). The internal diameter of the sealing tube 415 is accurate enough for seal compatibility. A port 417 located on the upper mandrel 412 allows a fluid such as water to be pumped into the bladder 50 through an annulus 416 and through a gap 418. In another embodiment, a second port located also on the upper mandrel 412 can be used to vent the air trapped in the bladder 50 during inflation.

FIG. 5 shows a detailed view of the stinger assembly 500. The stinger assembly is basically an extension to the drill pipe. The stinger assembly should have the same internal diameter as the drill pipes, so that conventional rubber plugs, usually called darts, used to separate fluids can easily run through. The bottom of the stinger assembly is a conventional liner hanger running tool. It has two main functions: it seals the running tool and the lower attachment assembly 400A (part of the bladder assembly 400, FIG. 4), and it connects the stinger assembly and the lower attachment assembly 400A, thanks to the internal recess 407, to actuate the latch tube 406 and to retrieve the bladder 50 at the end of the job.

The stinger assembly has an upper part 500B and a lower part 500A. The lower part 500A is made of a stinger mandrel 501 with a seal assembly 502 to fit into the mandrel 404 (part of the bladder assembly 400, FIG. 4). There is a collet 503 where several slots have been cut to form a set of elastic fingers 504 with a profile 505 to catch the internal recess 407 (FIG. 4) inside the latch tube 406 (FIG. 4). The collet 503 is pushed downward by a spring 506 so that the fingers 504 are located on a shoulder 540 on the stinger mandrel 501 that prevents them to collapse. When the stinger assembly is pushed downward through the latch tube 406 (FIG. 4), the fingers 504 stop against the internal recess 407 (FIG. 4), then the spring 506 is compressed and the fingers 504 are located in front of the smallest diameter 550 of the stinger mandrel 501. The front chamfer of the fingers 504, pushing on the latch tube upper chamfer, forces the fingers 504 to collapse. The fingers 504 can now engage through the internal recess 407 (FIG. 4). Once engaged, the spring 506 returns the fingers 504 to their original position, on the shoulder 540 on the stinger mandrel 501. The stinger assembly is latched, and the only way to release it is to compress the spring 506 and to collapse every finger 504 with a specific tooling.

A coupling 507 is connected on top of the stinger mandrel 501. A check valve assembly 507A, made of a puppet valve 508 pushed by a spring 509 and a nut 510, is installed in the thickness of the coupling. The check valve 507A ensures that the pressure inside the bladder 50 will never be lower than the pressure inside the stinger assembly. The drawing shows a very basic check valve located in the thickness of the coupling. However a concentric design with a sliding sleeve would be preferred to provide a larger flow area within the geometry of the tool. At the beginning of the job, the bladder 50 is filled with water at a very low pressure and the check valve 507A is closed. While the bladder is lowered downhole, the hydrostatic pressure increases and the bladder 50 is collapsed to increase its internal pressure. When the fluid is pumped through the drill pipes and the stinger assembly, the pressure inside the stinger assembly is slightly higher than the pressure inside the well, due to friction losses. So some fluid enters into the bladder 50 to increase its pressure, maintaining the bladder against the permeable tube 20.

Above the coupling 507, several tubular joints 511 are connected to obtain the same length as the permeable tube 20. The overall length can be adjusted by selecting short joints and/or an adjustable joint, so that the seals 502 engage the mandrel 404 (part of the bladder assembly 400, FIG. 4) when the liner hanger running tool 515 is secured in the nipple 307 (part of the liner string 300, FIG. 3).

Alternatively, the attachment of the liner hanger running tool 515 on the upper attachment assembly 400B (FIG. 4) can be made up on the rig floor: the bladder 50 is marked at surface when the lower attachment assembly 400A seats in the guide 302 (part of the liner string 300, FIG. 3), then it is slightly pulled of the hole, cut at the correct length, the sleeve 413 is crimped onto the bladder to secure it, and the liner hanger running tool 515 is run into the well.

The liner hanger running tool 515 shown in details on FIG. 5 is a conventional liner hanger running tool: a liner mandrel 521 has a spline 512A to link a left-hand thread nut 517 in rotation. The liner mandrel 521 can further be connected to a drill pipe or a coiled tubing. The nut 517 can translate in a rotating cage 519 with a thrust bearing 520. A spring 518 pushes the nut 517 out of the cage 519 to help engaging the left-hand thread nut 517 in the corresponding left-hand thread 309 (part of the liner string 300, FIG. 3). Then, even with some weight pressing the liner hanger running tool 515 down onto the nipple 307 (part of the liner string 300, FIG. 3), a right-hand rotation can easily unscrew the nut 517 that retracts inside the cage 519 until the liner hanger running tool 515 is totally disconnected from the liner string 300. Torque shear pins can be added to avoid any premature disconnection. The liner hanger running tool 515 also includes a seal assembly 513A made of a short stinger 513 with one or several seals 514 that engage inside the secure tube 415 (part of the bladder assembly 400, FIG. 4). A crossover 512 secures the stinger assembly 500 and the hanger liner running tool 515.

The apparatus 40 according to this second embodiment can be used for various types of permeable tubes as: perforated casing, perforated tubular, a tubular with other openings, a slotted liner or a screen (standalone or prepacked). The apparatus 40 can also be used for expandable permeable tubes as expandable tubular. However, the difference is that the expandable tubular is run and expanded first. Then the bladder is hanged at the rig floor level while the stinger assembly is made up. Finally the upper attachment assembly is secured on the stinger assembly. In order to bleed off the bladder at the top, a second telescopic latch tube, similar to the one in the lower attachment assembly, can be added to disengage the seals and vent the bladder.

Figure 6:
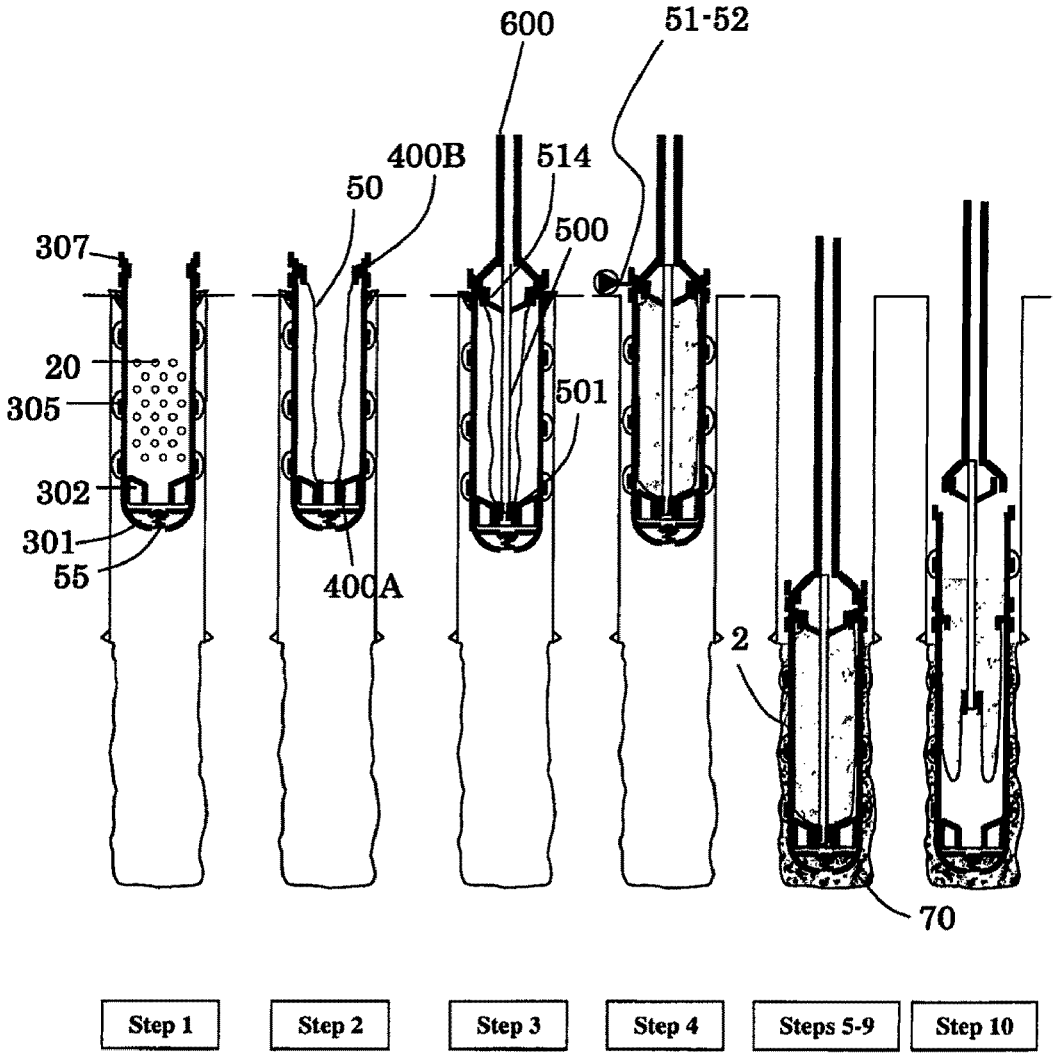
FIG. 6 shows a schematic diagram illustrating the method of the invention in a preferred embodiment.

FIG. 6 shows a preferred embodiment of the method of the invention. Said a preferred embodiment of the method can be deployed inside the well with the second embodiment of the apparatus of the invention.

In the first step, the permeable tube 20 is made up with the guide 302 above the shoe 301 and the nipple 307 on top. External centralizers 305 are installed all along the permeable tube 20. The running tool is used to connect it to drill pipes. Optionally, the liner hanger running tool and/or a packer is made up.

In the second step, the bladder 50 is run inside the permeable tube 20. It is made of a flexible hose connected to two attachment assemblies (400A of the lower and 400B for the upper). The bladder is spooled on a reel and a pulley is guiding it during deployment in the permeable tube, until the upper attachment assembly seats into the nipple 307.

In the step three, the apparatus 40 is prepared: the stinger assembly 500 is assembled inside the bladder 50. The stinger mandrel 501 fits into the lower attachment assembly 400A. Then the running tool 600 is secured in the nipple 307 at the top of the permeable tube 20 and at this moment, the several seals 514 engage into the upper attachment assembly 400B.

In the step four, the bladder 50 can now be inflated with any liquid for test purpose, through the filling ports 308 and 417. The check valve 51-52 prevents the bladder to deflate into the well.

In the step five, the apparatus 40 is run in the well with drill pipes. The pressure in the bladder automatically raises up to the hydrostatic pressure, thanks to the check valve. In the step six, once the lower section 42 is at the desired depth, the liner hanger running tool (if any) is set and the running tool disconnected (but left in place) for safety reasons. In the step seven, the cement slurry 70 can be pumped through the drill pipes and the stinger assembly 500. It is circulating through the shoe 301 and back up the annulus 2. The stinger assembly pressure is always slightly higher than the annulus pressure. As the bladder is inflated by the stinger assembly pressure, it is maintained against the permeable tube thanks to the check valve 51-52, so it prevents the cement slurry 70 to circulate between the outside of the bladder and the inside of the permeable tube. In the step eight, the apparatus is left in place until the cement is set. In the step nine, by pulling on the drill pipe, the stinger assembly pulls on the stinger mandrel 501 and the fingers 504 which finally disengage latch tube 406 to create a path for fluid circulation so to vent the bladder.

In the step ten, by pulling more on the drill pipe, the running tool 600, the stinger assembly 500 and the lower attachment assembly 400A are coming out of the well, while the bladder bleeds off and turns inside out, hanging below the lower attachment assembly 400A. The whole apparatus can be retrieved, except the permeable tube. No cement is located inside the permeable tube.

In the above sequence, the bladder was pre-inflated at surface on the step four for test purposes. Alternatively, that test can be eliminated to save time, and the bladder will inflate by circulating the mud through the check valve 51-52, once it is arrived at desired depth. Optionally, a ball or a dart can be pumped down to close the bottom of the stinger assembly and to apply some pressure into the bladder. Then the ball seat can shear to establish the free circulation, but the bladder stays pressurized because the check valve is now closed.

The invention claimed is:

1. A method of treatment of a near zone of a well, a far zone of a well or both a near zone and a far zone of a well comprising a wellbore and wherein the method comprising:

(i) placing inside the wellbore a tube which is permeable to a material, so that the tube forms an annulus with the wellbore, a first zone being inside the annulus and a second zone being in the formation adjacent the wellbore;

(ii) placing inside the tube a setting section surrounded by an expanding sleeve, the setting section having a delivery opening located at the lower end of the setting section below the sleeve and the sleeve being expandable and impermeable to the material;

(iii) inflating the sleeve so that the sleeve is in contact with the portion of the tube defining the near zone, ensuring that the first zone of the tube is impermeable to the material, but leaving the second zone permeable to the material;

(iv) pumping a treatment fluid to the near and far zones; and (v) treating the near zone, the far zone or both near zone and far zone with the treatment fluid wherein the setting section has an upper part and a lower part, the setting section being connected to a delivery section going on surface at the upper part, and being in communication with the inside of the well at the lower part through the delivery opening, and wherein the step (iv) of pumping a treatment fluid to the zones is done by:

delivering the treatment fluid inside of the well through the delivery section, through the setting section and through the delivery opening;

filling the inside of the well located downhole from the lower part with the treatment fluid, until the treatment fluid passes into the annulus via the second zone still permeable to said material; and rising said treatment fluid into the near zone or the far zone or both.

2. The method of claim 1, wherein the second zone is a void making communication with the near zone to treat.

3. The method according claim 1, further comprising: deflating the sleeve so that the sleeve is no longer in contact with the tube near the near and far zones.

4. The method according claim 1, further comprising: removing the setting section surrounded by the sleeve.

5. The method according to claim 4, further comprising: deflating the sleeve so that the sleeve is no longer in contact with the tube near the near and far zones.

6. The method according to claim 1, wherein step (ii) of placing a setting section surrounded by a sleeve is performed by first placing the sleeve inside the tube and then placing the setting section inside the sleeve.

7. The method according to claim 1, wherein step (ii) of placing a setting section surrounded by a sleeve is performed by placing into the tube the setting section already surrounded by the sleeve.

8. The method according to claim 1, wherein the well has a longitudinal axis (A) and wherein the step (ii) of placing a setting section surrounded by a sleeve further comprises the step of deploying the sleeve longitudinally to the axis (A).

9. The method according to claim 1, wherein the setting section has an upper part and a lower part, the setting section being connected to a delivery section going on surface at the upper part, and being in communication with the inside of the well at the lower part through a delivery opening, and wherein the step (iv) of pumping a treatment fluid to the near and far zones is performed by:

delivering the treatment fluid inside of the well through the delivery section, through the setting section and through the delivery opening;

filling the inside of the well located downhole from the lower part with the treatment fluid, until the treatment fluid passes into the annulus via the second zone still permeable to the material; and rising the treatment fluid into the near zone, the far zone or both.

10. The method according to claim 1, wherein the setting section is a member of the list consisting of: coiled tubing and drill pipe.

11. The method according to claim 9, wherein the delivery section is a member of the list consisting of: coiled tubing and drill pipe.

12. The method of claim 1, wherein the treatment fluid is a member of the list consisting of: viscous bentonite fluid, a delayed-gel fluid and a reactive fluids system.

13. The method according to claim 1, wherein the setting section is a member of the list consisting of: coiled tubing and drill pipe.

14. The method according to claim 1, wherein the delivery section is a member of the list consisting of: coiled tubing and drill pipe.

15. The method according to claim 1, wherein the setting section has an upper part and a lower part, the setting section being connected to a delivery section going on surface at the upper part, and being in communication with the inside of the well at the lower part through a delivery opening, and wherein the step (iv) of pumping a treatment fluid to the near and far zones is performed by:

deploying a plug inside of the well;

plugging the inside of the well located downhole from the lower part with the plug;

delivering the treatment fluid inside of the well through the delivery section, through the setting section and through the delivery opening;

filling the inside of the well located downhole from the lower part and uphole from the plug, with the treatment fluid, until the treatment fluid passes into the annulus via the second zone still permeable to the material; and rising the treatment fluid into the near zone, the far zone or both the near and far zones.

16. The method of claim 15, wherein the plug is a device with an expandable sleeve which acts as a plug when the expandable sleeve is inflated.

17. The method according to claim 15, wherein the setting section is a member of the list consisting of: coiled tubing and drill pipe.

18. The method according to claim 15, wherein the delivery section is a member of the list consisting of: coiled tubing and drill pipe.

19. The method according to claim 1, wherein the tube is a member of the list consisting of: perforated casing, perforated tubing, perforated pipe, perforated conduit, slotted liner, screen, expandable casing, expandable screen, tube comprising an opening, tube comprising a permeable component, and a permeable component.

20. The method according to claim 1, wherein the material is one or more members of the list consisting of: oil, water, cement, sand, gravel and gas.

21. The method according to claim 1, wherein the setting section is a member of the list consisting of: coiled tubing and drill pipe.

22. The method according to claim 1, wherein the sleeve is made of rubber.

23. The method according to claim 1, wherein the treatment fluid is a settable fluid.

24. The method according to claim 1, wherein the treatment fluid is a settable fluid and further comprising:

(vi) allowing the treatment fluid to set;

(vii) deflating the sleeve so that the sleeve is no longer in contact with the tube near the near and far zones; and (viii) removing the setting section with the sleeve by putting it out.

25. The method of claim 24, wherein the settable fluid is a member of the list consisting of: conventional cement, remedial cement, permeable cement, phosphate cement, special cement, inorganic and organic sealants, remedial resin, permeable resin and geopolymer materials.

26. The method of claim 24, further comprising:

(ix) drilling the well with a drilling tool.

27. The method of claim 24, wherein the settable fluid is a member of the list consisting of: conventional cement, remedial cement, permeable cement, phosphate cement, special cement, inorganic and organic sealants, remedial resin, permeable resin and geopolymer materials.

28. An apparatus for treatment of a near zone of a well, a far zone of a well or both a near zone and a far zone of a well, comprising a wellbore, and the apparatus comprising:

(i) a stinger assembly comprising a stinger mandrel at the lower part, and a seal and a first thread at the upper part;

(ii) a bladder assembly comprising a bladder which is expandable and impermeable to a material, a check valve for inflating the bladder, a lower attachment assembly and an upper attachment assembly, wherein the stinger mandrel fits in the lower attachment assembly and the seal fits in the upper attachment assembly;

(iii) a liner string comprising a tube which is permeable to the material and comprising a delivery opening for delivering a treatment fluid, a guide, a seat and a second thread, wherein the lower attachment assembly fits in the guide, the upper attachment assembly fits in the seat and the first thread fits in the second thread; and (iv) a running tool going to surface and connected to the stinger assembly at the upper part, wherein the check valve ensures inflation so that the sleeve is in contact with a first zone of the tube so that the first zone of the tube becomes impermeable to the material and the delivery opening ensures delivery so that the treatment fluid passes, via a second zone still permeable to the material, into an annulus formed between the stinger assembly and the wellbore and into the near and far zones.

29. The apparatus according to claim 28, wherein the tube is a member of the list consisting of: perforated casing, perforated tubing, perforated pipe, perforated conduit, slotted liner, screen, expandable casing, expandable screen, tube comprising opening, tube comprising permeable component, and permeable component.

30. The apparatus according to claim 28, wherein the material is one or more members of the list consisting of: oil, water, cement, sand, gravel and gas.

31. The apparatus according to claim 28, wherein the check valve delivers a gas, a liquid or both inside the bladder.

32. The apparatus according to claim 28, wherein the treatment fluid is a settable fluid.

33. The apparatus of claim 32, wherein the settable fluid is a member of the list consisting of conventional cement, remedial cement, permeable cement, special cement, remedial resin and permeable resin.

* * * * *